US008668080B1

(12) United States Patent
Kazanchyan et al.

(10) Patent No.: US 8,668,080 B1
(45) Date of Patent: Mar. 11, 2014

(54) METHOD AND DEVICE FOR STORING AND TRANSPORTING JEWELRY

(76) Inventors: Anna Kazanchyan, White Plains, NY (US); Mariam Aghavni Markarian, White Plains, NY (US)

( * ) Notice: Subject to any disclaimer, the term of this patent is extended or adjusted under 35 U.S.C. 154(b) by 336 days.

(21) Appl. No.: 13/329,958

(22) Filed: Dec. 19, 2011

Related U.S. Application Data

(60) Provisional application No. 61/425,906, filed on Dec. 22, 2010.

(51) Int. Cl.
*A45C 11/04* (2006.01)

(52) U.S. Cl.
USPC ..... 206/6.1; 63/33

(58) Field of Classification Search
USPC ..... 206/6.1, 348, 301, 18, 19; 63/1.18, 33, 63/24, 40; 383/41; 2/129; 119/856, 857
See application file for complete search history.

(56) References Cited

U.S. PATENT DOCUMENTS

| | | | | |
|---|---|---|---|---|
| 356,524 | A | 1/1887 | Clement | |
| 2,892,541 | A | 6/1959 | Hahn | |
| 3,876,065 | A | 4/1975 | Phelps | |
| 3,997,050 | A | 12/1976 | Patterson | |
| 4,016,972 | A | 4/1977 | Szamborski | |
| 4,697,436 | A * | 10/1987 | Schmidt | 63/3 |
| 4,726,469 | A | 2/1988 | Farber | |
| 5,211,284 | A | 5/1993 | Parks | |
| 5,222,797 | A | 6/1993 | Holland | |
| 5,383,100 | A | 1/1995 | Kikos | |
| 5,617,947 | A | 4/1997 | Momjian | |
| 5,971,612 | A | 10/1999 | McAuslan | |
| 6,106,129 | A | 8/2000 | Cranor | |
| D590,568 | S * | 4/2009 | Crutchfield | D34/27 |
| 8,424,341 | B2 * | 4/2013 | Summerford | 206/6.1 |
| 2010/0236287 | A1 * | 9/2010 | Summerford | 206/6.1 |

* cited by examiner

*Primary Examiner* — Mickey Yu
*Assistant Examiner* — Chun Cheung
(74) *Attorney, Agent, or Firm* — Jason L. Gilbert

(57) ABSTRACT

A method and device for storing and transporting jewelry which generally includes a flexible, tubular, and transparent sleeve having a first angled end and a second angled end opposite thereof. The first end and the second end each have angled openings leading to an internal cavity. A jewelry item is inserted within the sleeve so that the first end and second end of the jewelry protrude from the first and second end of the sleeve. The first and second end of the sleeve are then extended over the first and second ends of the jewelry and connected to each other, such as by tying, or through the use of various types of fasteners so that the jewelry is completely enclosed within the sleeve in a conventional clasped circular-shaped orientation that will prevent tangling of the jewelry and allow the jewelry to be stored, hung on display, worn, or easily transported.

10 Claims, 13 Drawing Sheets

METHOD AND DEVICE FOR STORING AND TRANSPORTING JEWELRY

CROSS REFERENCE TO RELATED APPLICATIONS

I hereby claim benefit under Title 35, United States Code, Section 119(e) of U.S. provisional patent application Ser. No. 61/425,906 filed Dec. 22, 2010. The 61/425,906 application is currently pending. The 61/425,906 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a jewelry storage device and method and more specifically it relates to a method and device for storing, displaying, holding and transporting jewelry in an aesthetically appealing sleeve which prevents tangling, warping, breaking or damaging of the jewelry and which retains jewelry in a conventional circular position while fully enclosing the jewelry.

2. Description of the Related Art

Any discussion of the related art throughout the specification should in no way be considered as an admission that such related art is widely known or forms part of common general knowledge in the field.

Jewelry is often the most prized possession of its owner. Generally, when storing jewelry, individuals generally use either furniture drawers or devices such as jewelry boxes, jewelry stands, jewelry trees and the like. These devices are usually simply comprised of a housing in which jewelry is freely deposited or hung from and allowed to comingle with other jewelry.

When storing jewelry in such prior art devices, the jewelry can often become tangled either with itself or with other jewelry. It can be difficult to untangle, is unusable if tangled and can often end up being warped, damaged or broken when untangling is attempted. Additionally, prior art devices are often bulky, rigid, unattractive, inflexible, non-portable and non-transparent. When traveling via train or plane, individuals are even further limited in their choices for transporting jewelry. Many jewelry owners end up putting their jewelry in the zipped pocket of their handbags, which often leads to tangled, warped or damaged jewelry.

Because of the inherent problems with the related art, there is a need for a new and improved method and device for storing, displaying, holding and transporting jewelry in an aesthetically appealing sleeve which prevents tangling of the jewelry.

BRIEF SUMMARY OF THE INVENTION

The invention generally relates to a jewelry storage, holding, display and transport system which includes a flexible, tubular and preferably transparent or semi-transparent sleeve having a first angled end and a second angled end opposite thereof. The first end and the second end each have angled openings extending through for connecting to a generally linear, straight interior channel extending between thereof. A jewelry item, generally comprising a necklace or bracelet, is inserted linearly within the sleeve so that the first end and second end of the jewelry protrude from the first and second end of the sleeve. The ends of the jewelry are clasped to retain a conventional circular shape of the jewelry. The first and second end of the sleeve are then extended over the first and second ends of the jewelry and connected to each other, such as by tying, or through the use of various types of fasteners (e.g. clasps, snaps, hooks, VELCRO, magnets) so that the jewelry is completely enclosed within the sleeve in a conventional clasped circular-shaped orientation that will prevent tangling or damaging of the jewelry and allow the jewelry to be stored, hung on display, worn, or easily transported.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
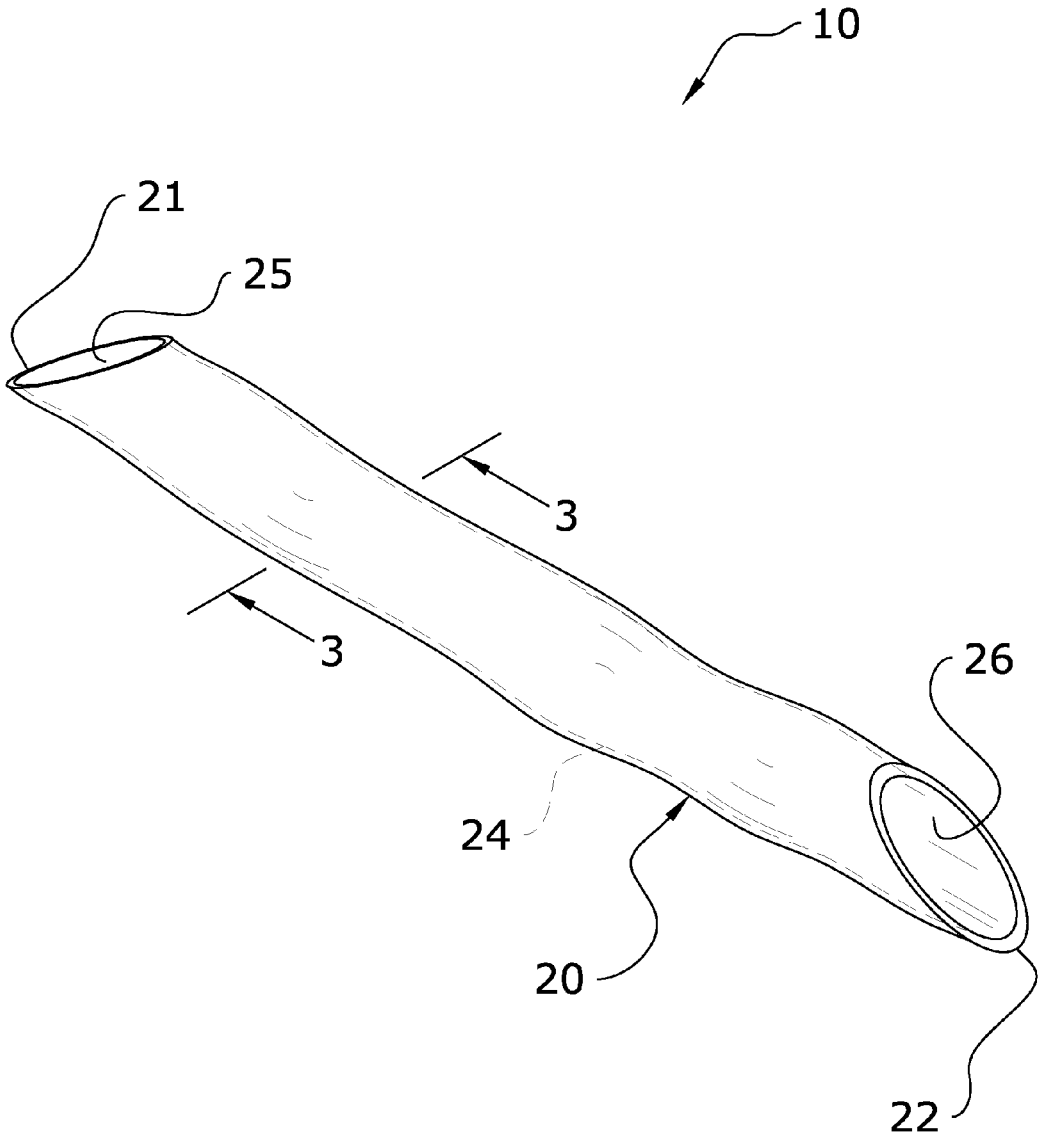
FIG. 1 is an upper perspective view of the sleeve of the present invention.

Turning now descriptively to the drawings, in which similar reference characters denote similar elements throughout the several views, FIGS. 1 through 9 illustrate a device and method for storing, holding, displaying and transporting jewelry 10, which comprises a flexible, tubular, and preferably transparent or semi-transparent sleeve 20 having a first angled end 21 and a second angled end 22 opposite thereof. The first end 21 and the second end 22 each have angled openings 25, 26 extending through for connecting to a generally linear, straight interior channel 24 extending between thereof. A jewelry item 12, generally comprising a necklace or bracelet, is inserted linearly within the sleeve 20 so that the first end 13 and second end 14 of the jewelry 12 protrude from the first and second end 21, 22 of the sleeve 20. The ends 13, 14 of the jewelry are clasped to retain a conventional circular shape of the jewelry 12. The first and second end 21, 22 are then extended over the first and second ends 13, 14 of the jewelry 12 and connected to each other, such as by tying, or through the use of various types of fasteners 28, 29 (e.g. clasps, snaps, hooks, VELCRO, magnets) so that the jewelry 12 is completely enclosed within the sleeve 20 in a conventional clasped circular-shaped orientation that will prevent tangling of the jewelry 12 and allow the jewelry 12 to be stored, hung on display, worn, or easily transported.

For necklaces and bracelets that do not possess a clasp, such as that are already in an endless loop configuration, the user can hold the necklace 12 at the top so that the necklace 12 hangs down as two chains and subsequently insert the necklace as such into the sleeve 20. The user then inserts the first and second end 21, 22 under each end 13, 14 of the necklace 12 and connects them to each other.

As stated, the present invention is generally used to retain and enclose jewelry 12, such as bracelets and necklaces. However, the present invention may be used to enclose, display, store, or transport various other items, objects, articles, of an elongated and generally bendable or flexible structure that may be inserted within the sleeve 20. The enclosure 20 may also be used to transport multiple necklaces at the same time. Alternately, the jewelry 12 or other object or item may be stored or displayed within the sleeve 20 while retaining the sleeve 20 in a horizontal or vertical orientation rather than the preferred circular continuous and endless-loop orientation. Additionally, multiple sleeves may be attached to each other lengthwise via stitching or other permanent or non-permanent means (i.e., Velcro, snaps, hooks, clasps, magnets, etc.) to enable the storage, display or transportation of multiple necklaces, bracelets or other items.

The present invention solves many of the problems commonly associated with storing, displaying, and transporting jewelry, wherein prior jewelry containers, such as jewelry bags, jewelry boxes, jewelry stands, jewelry trees, jewelry rolls, jewelry T-bars, cases, etc. can often lead to tangled, unorganized, or damaged jewelry. In addition, many of the prior jewelry containers can be bulky, rigid, unattractive, inflexible, non portable, and non transparent, in addition prohibiting the jewelry from maintaining a conventional clasped circular-shape while fully enclosing the jewelry, or are not of a lightweight construction, and cannot be worn by the user while enclosing the jewelry among other short-comings.

B. Sleeve

Figure 2:
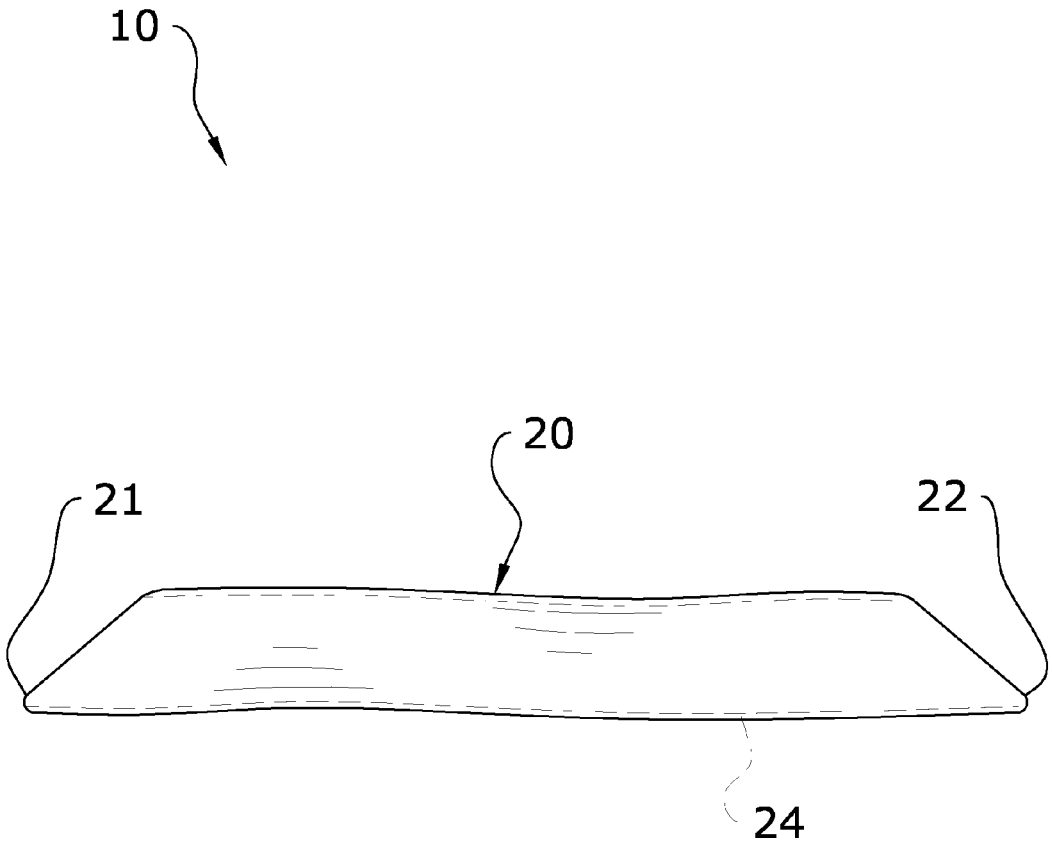
FIG. 2 is a top view of the sleeve of the present invention.
Figure 3:
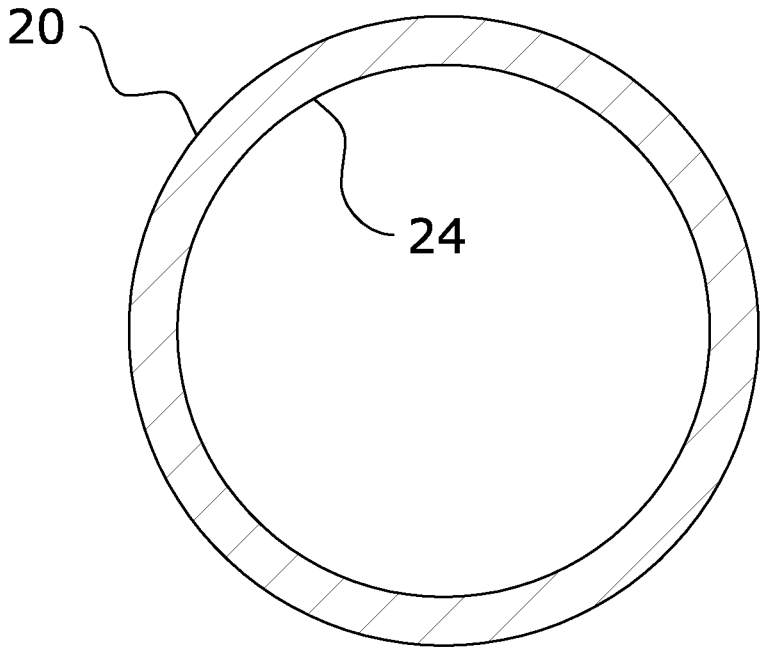
FIG. 3 is a front cross-sectional view of the sleeve of the present invention.

As illustrated in FIGS. 1 through 3, the sleeve 20 is generally comprised of a flexible, lightweight, tubular device having an angled first end 21 and second end 22, each of the ends 21, 22 having an opening 25, 26 leading to an interior channel 24 extending through the sleeve 20 and configured to enclose the clasped jewelry 12 (e.g. necklace, bracelet) entirely while maintaining the conventional clasped circular-shape of the jewelry 12. The sleeve 20 may be comprised of various lengths to hold various sized jewelry 12. In addition, the sleeve 20 may be comprised of various diametric sizes to hold various sized jewelry 12 or multiple jewelry items 12 therein, such as when multiple smaller sized jewelry items (e.g. necklaces, bracelets) of the same length are inserted within the sleeve 20 instead of a single, lengthy jewelry item (e.g. necklace, bracelet). The sleeve 20 may employ a hollow circular, rectangular, or other cross-sectional shaped structure.

The sleeve 20 is generally comprised of a flexible fabric material that may be manipulated in various shapes; however various plastics or other materials may be appreciated with such materials providing the ability to collapse the sleeve into a compact structure (similar to pleats construction). The sleeve 20 is also preferably transparent, semi-transparent; however the sleeve 20 may be non-transparent or comprised of various colors as appreciated. The sleeve 20 may also have various decorative features thereon or integral with the sleeve 20 for enhancing the appearance of the jewelry 12 enclosed therein, such as when displaying the enclosed jewelry 12 and sleeve 20 or wearing the jewelry 12 while enclosed within the sleeve 20.

Each of the ends 21, 22 are generally angled relative a longitudinal axis of the sleeve 20 and interior channel 24, and mirror each other about the sleeve 20, wherein each of the ends 21, 22 has a top outwardly extending from an inwardly spaced bottom, so as to angle inwardly from a top to a bottom of the angled end 21, 22. The angled ends 21, 22 allow for easier insertion and removal of the jewelry 12 and also permit easier tying of the ends 21, 22 to fully enclose the jewelry 12.

In alternate embodiments of the sleeve 20 as illustrated in FIGS. 9-11 and 13, the first end 21 may include a first fastener 28 and the second end 22 may include a second fastener 29. The first fastener 28 and the second fastener 29 may be used for connecting the first end 21 to the second end 22 by connecting the first fastener 28 to the second fastener 29 when forming a circular structure with the sleeve 20 and continuously looped interior channel 24. Embodiments of the first fastener 28 and the second fastener 29 may include, but are not limited to magnets, clasps, snaps, hooks, hook and loop fasteners (i.e. VELCRO), ribbons sewn onto the first and second ends 21, 22, or alternately a ribbon or elongated member that protrudes from the top, bottom, or both of the first and/or second ends 21, 22 or from other locations upon the sleeve 20.

C. Operation of Preferred Embodiment

Figure 4:
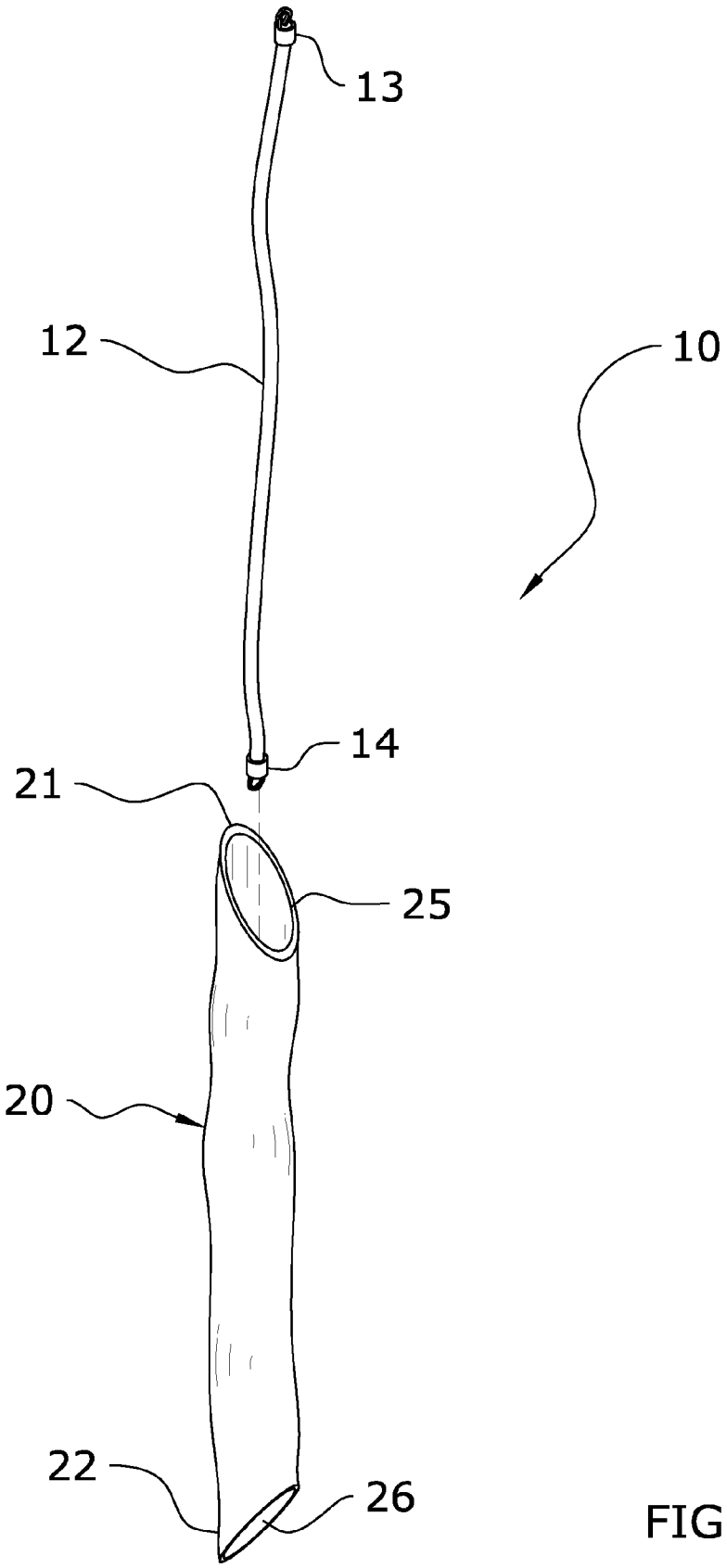
FIG. 4 is a side view of a piece of jewelry being positioned within the sleeve of the present invention.
Figure 5:
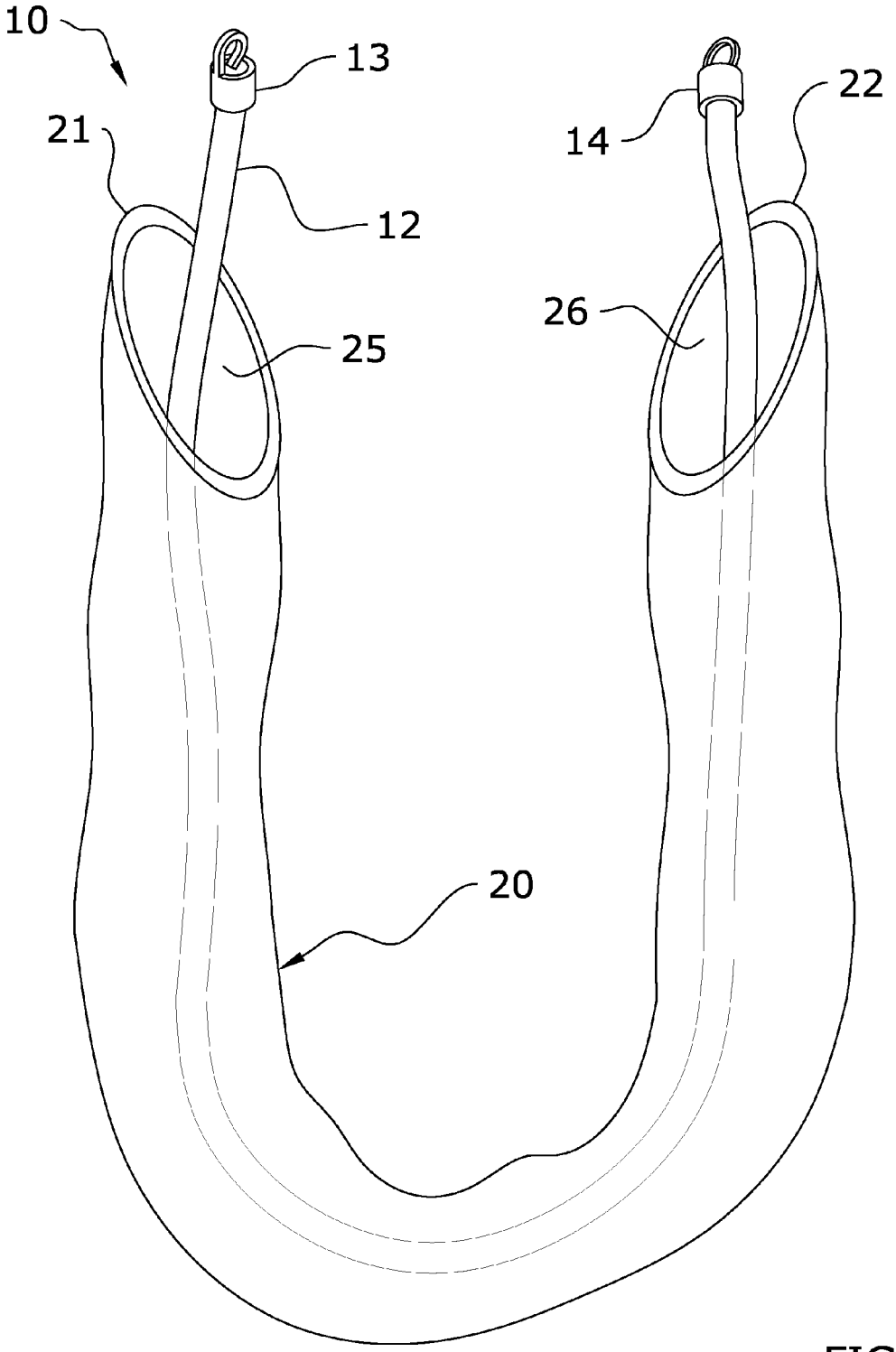
FIG. 5 is a side view of a piece of jewelry positioned within the sleeve of the present invention.
Figure 6:
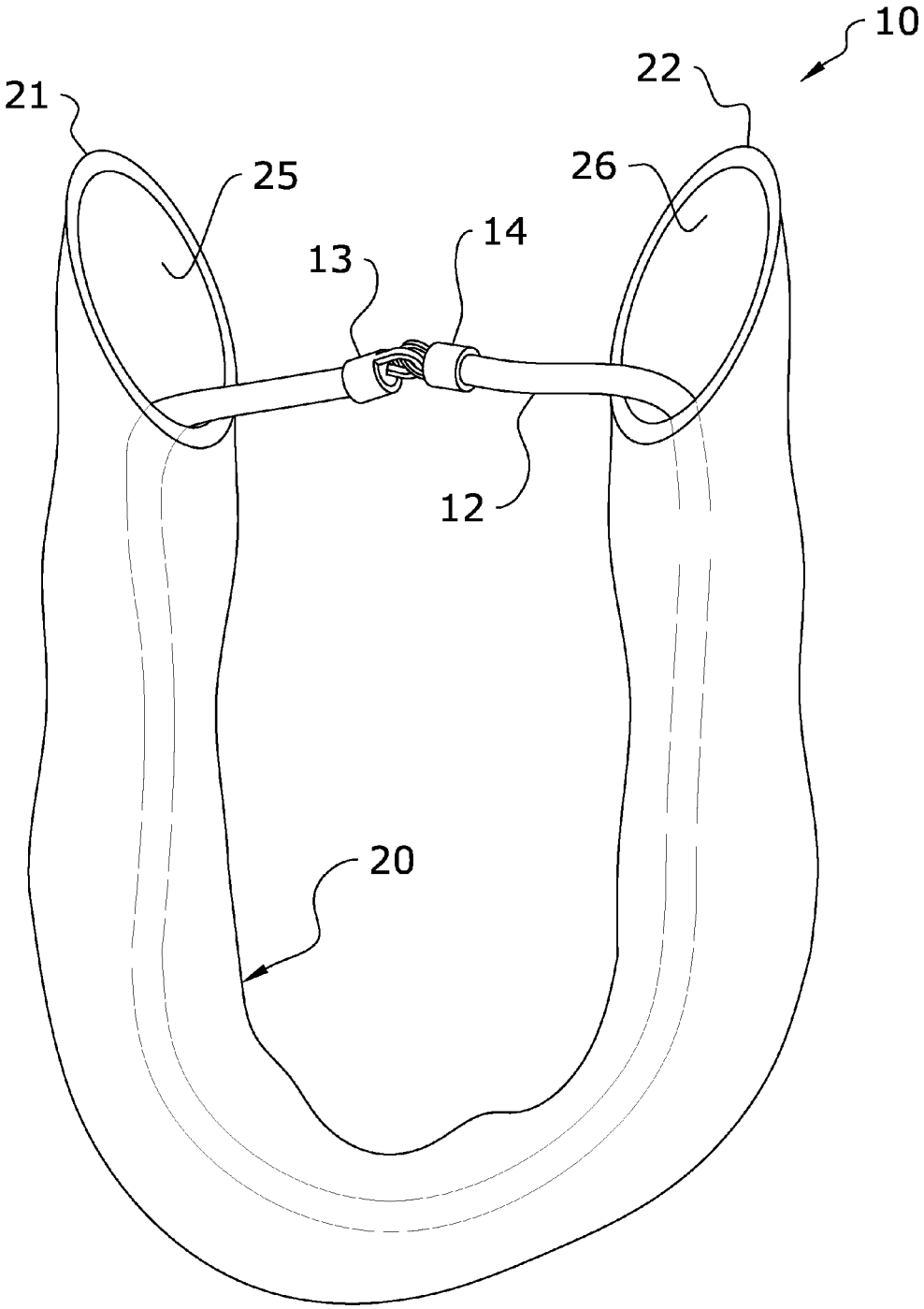
FIG. 6 is a side view of a piece of jewelry positioned within the sleeve of the present invention

In use, the user holds the first end 21 of the sleeve 20 while holding the sleeve 20 in vertical position and inserts or drops the jewelry 12, such as the necklace or bracelet into the first opening 25 of the first end 21 of the sleeve 20 and within the interior channel 24 while holding the first end 13 of the jewelry 12 as illustrated in FIG. 4. Once the second end 14 of the jewelry 12 exits from the second opening 26 of the second end 22 of the sleeve 20, the user grasps the second end 14 of the jewelry 12 and clasps the second end 14 of the jewelry 12 that is extending outwardly from the second end 22 of the sleeve 20 to the first end 13 of the jewelry 12 that is extending outwardly from the first end 21 of the sleeve 20 so that the jewelry 12 is in a conventionally clasped circular-shape as illustrated in FIGS. 5 and 6.

Figure 7:
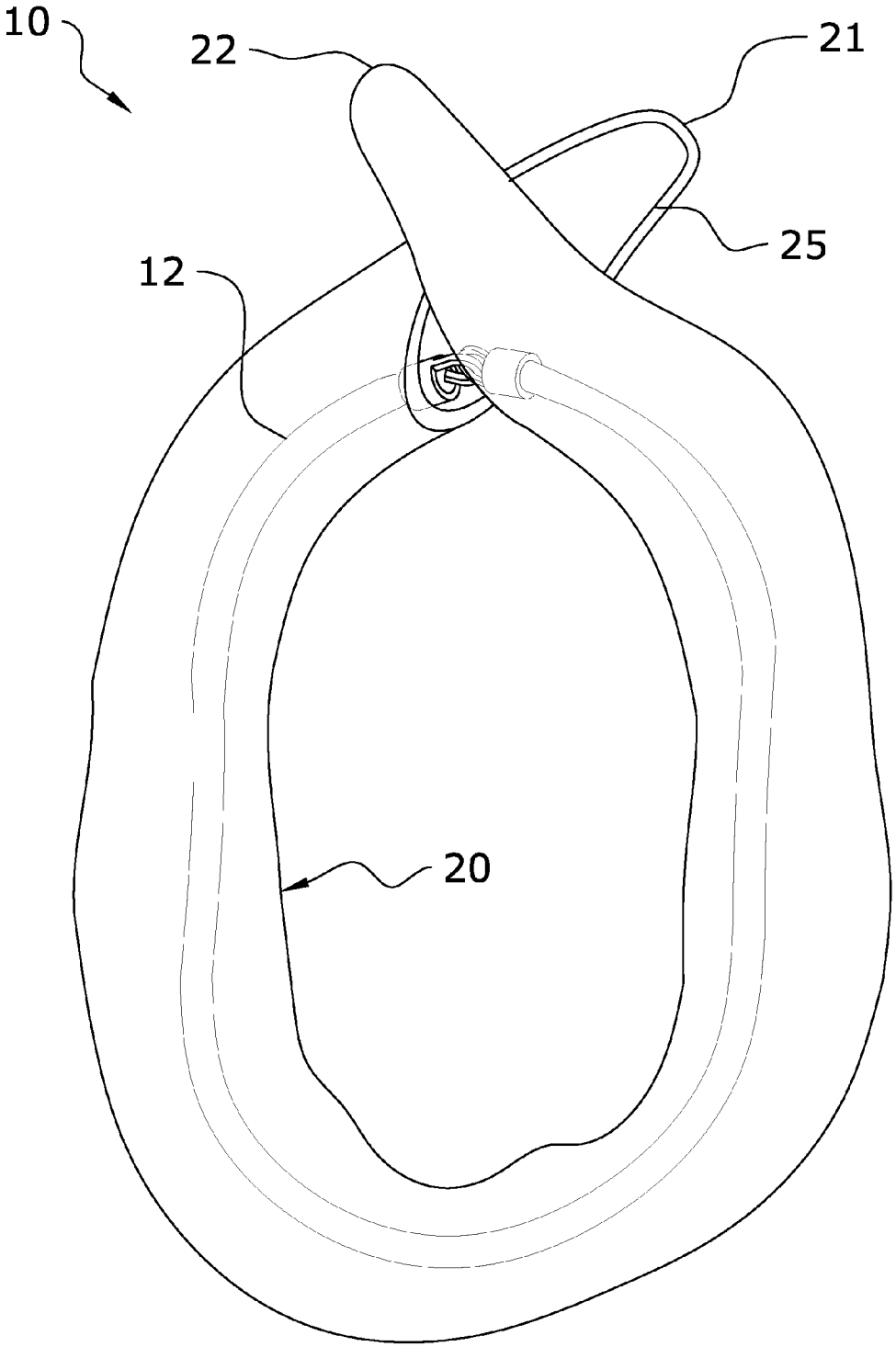
FIG. 7 is a side view of the sleeve being secured around a piece of jewelry.
Figure 8:
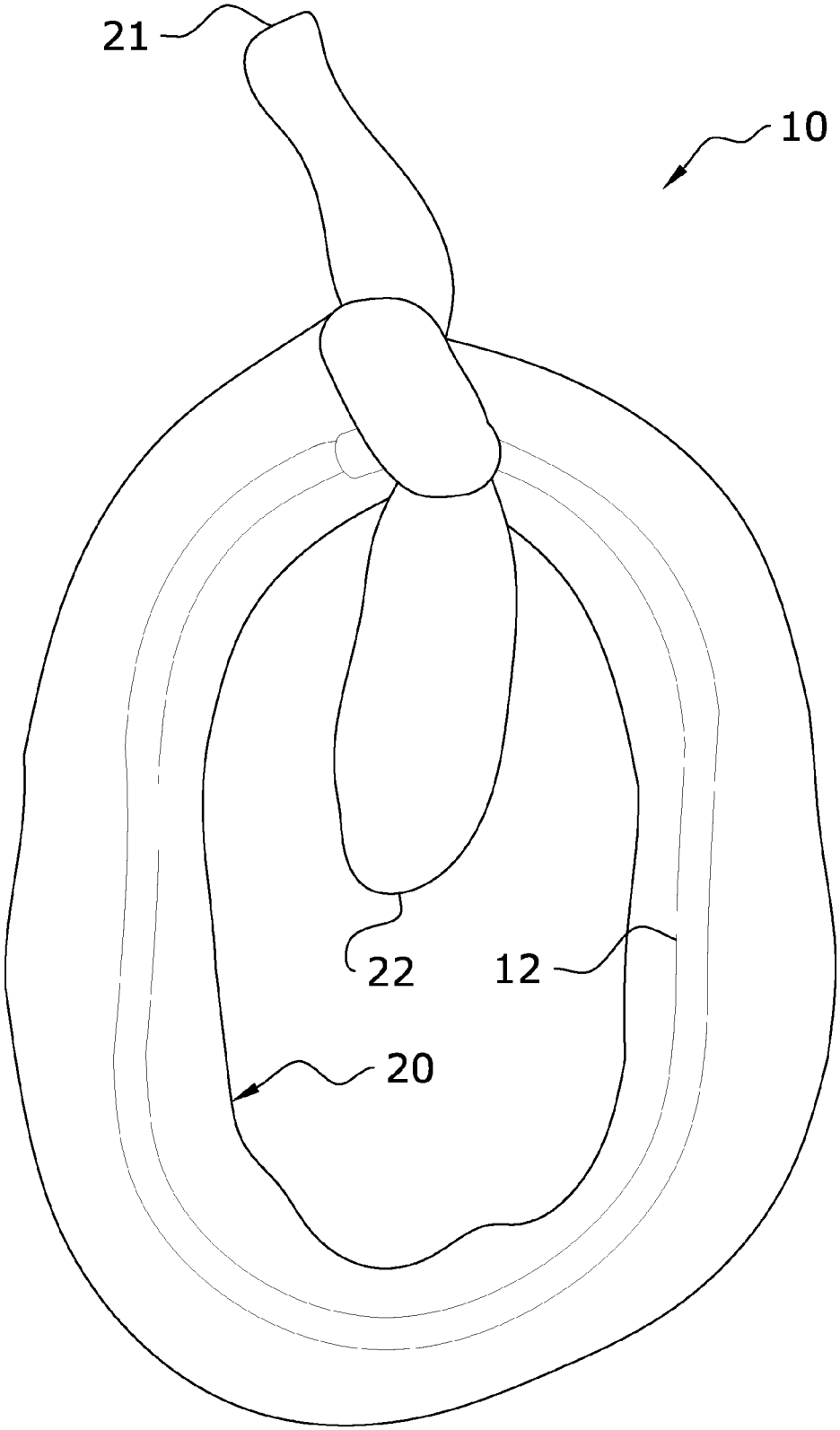
FIG. 8 is a side view of a piece of jewelry secured within the sleeve.
Figure 9:
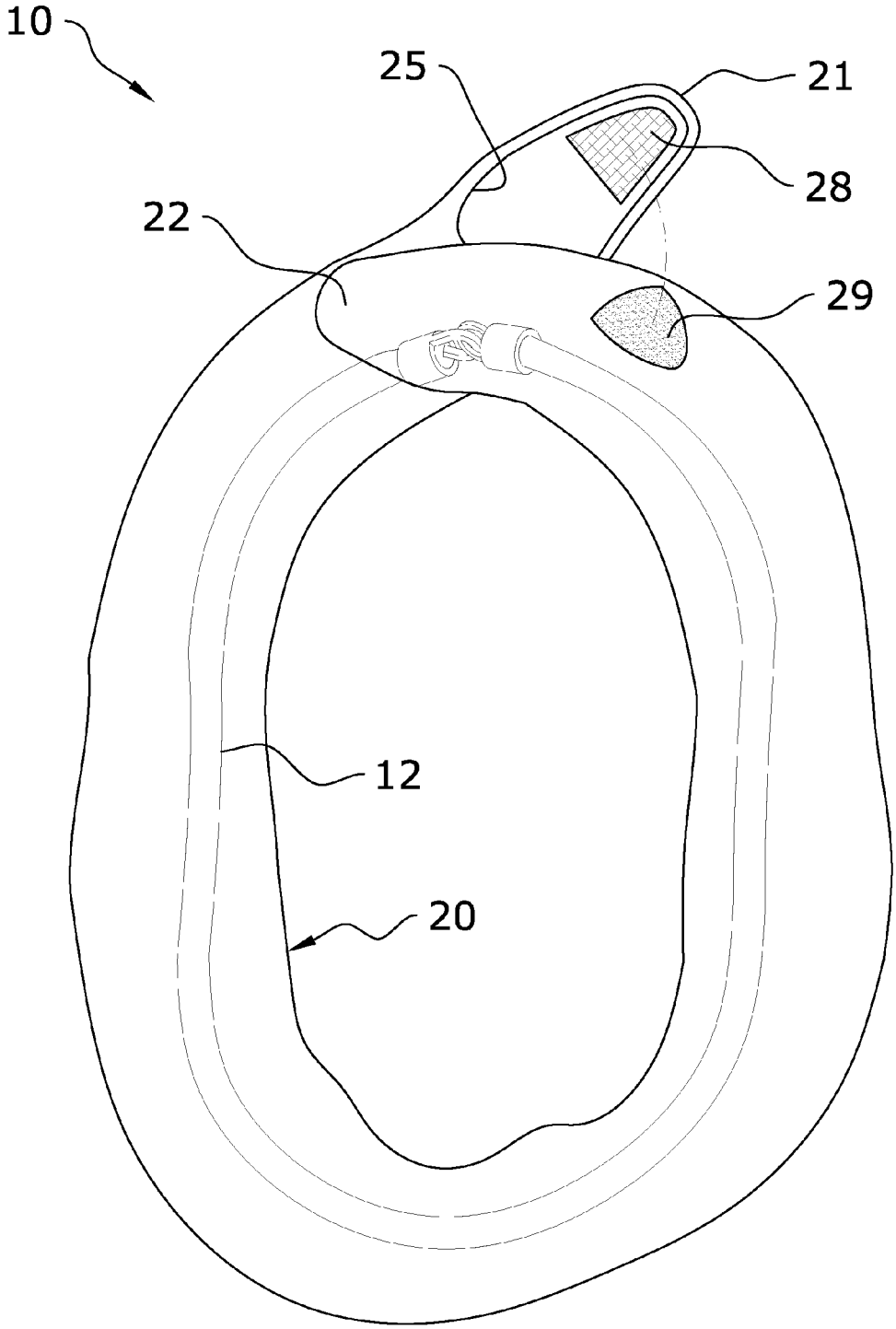
FIG. 9 is a side view of a first alternate embodiment of the present invention in use.
Figure 10:
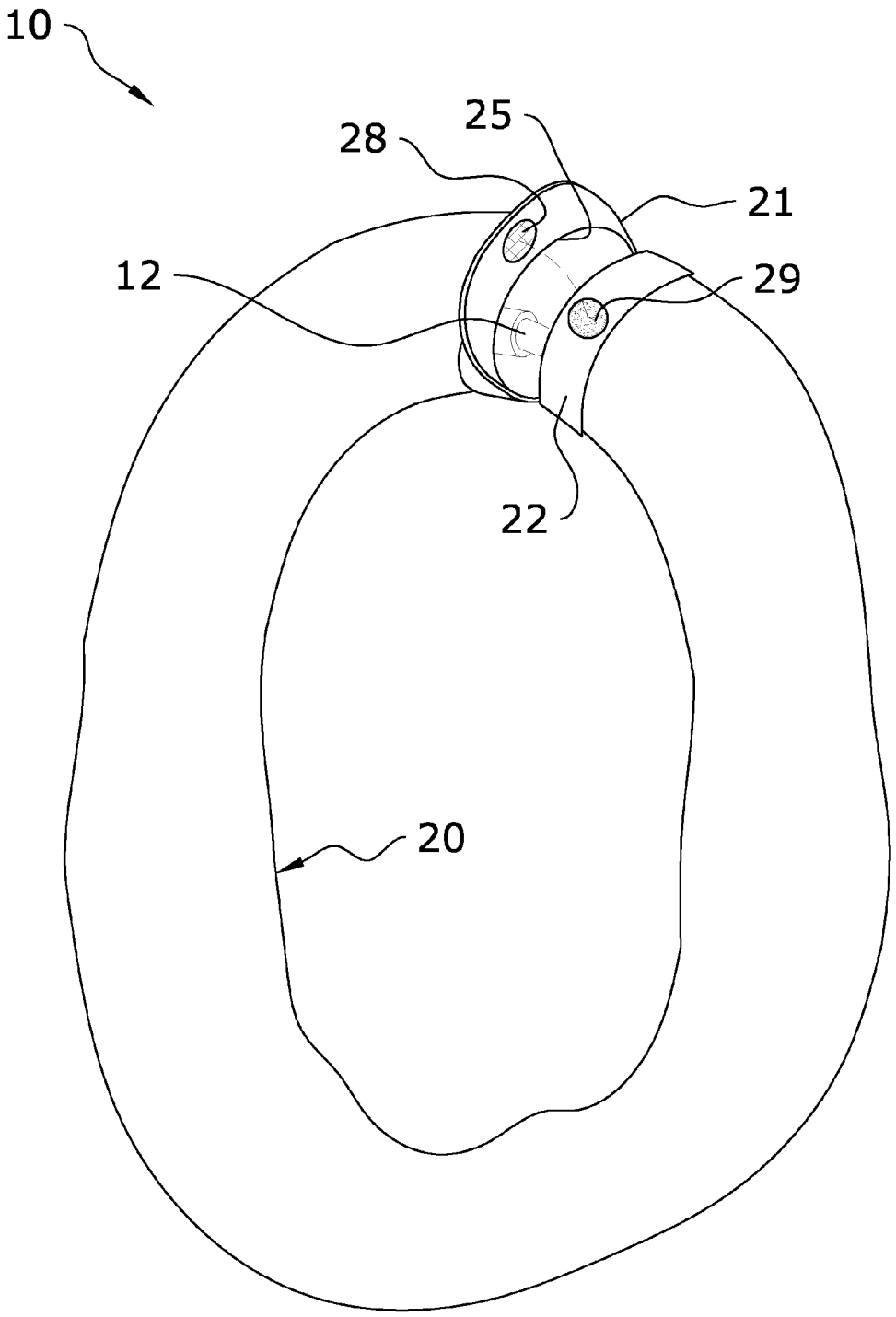
FIG. 10 is a side view of a second alternate embodiment of the present invention in use.
Figure 11:
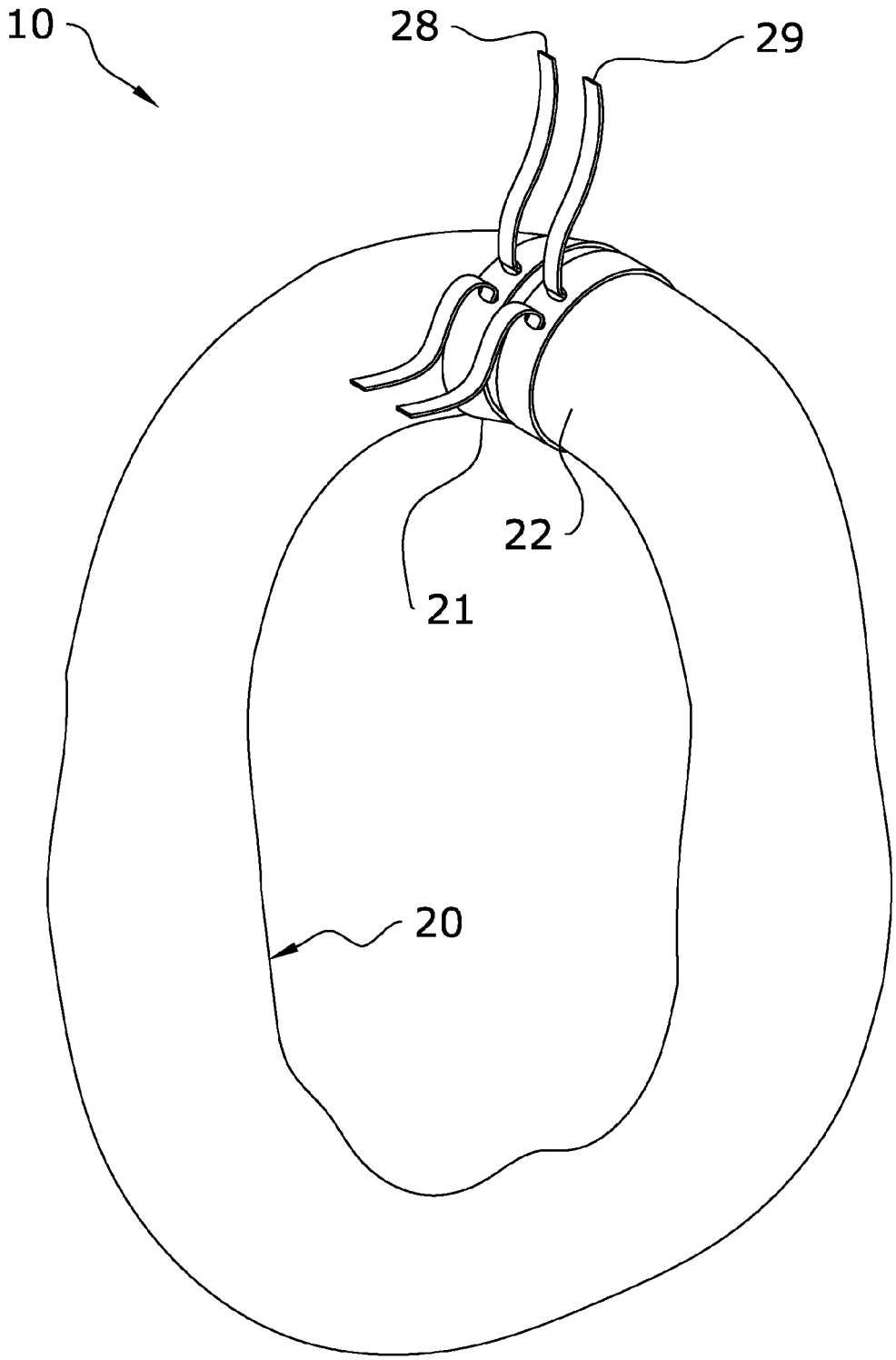
FIG. 11 is a side view of a third alternate embodiment of the present invention in use.
Figure 12:
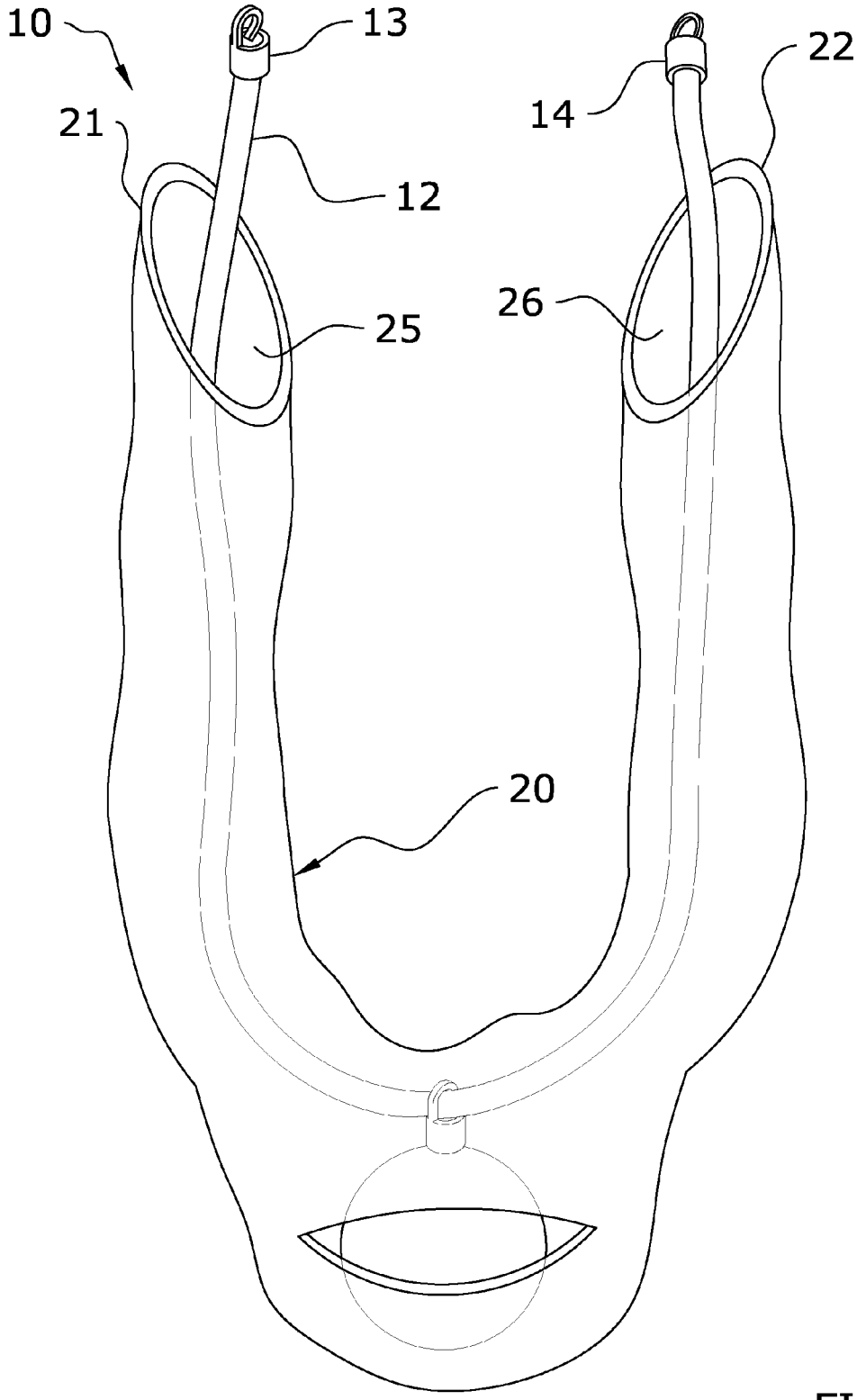
FIG. 12 is a side view of the present invention in use storing jewelry having a pendent.
Figure 13:
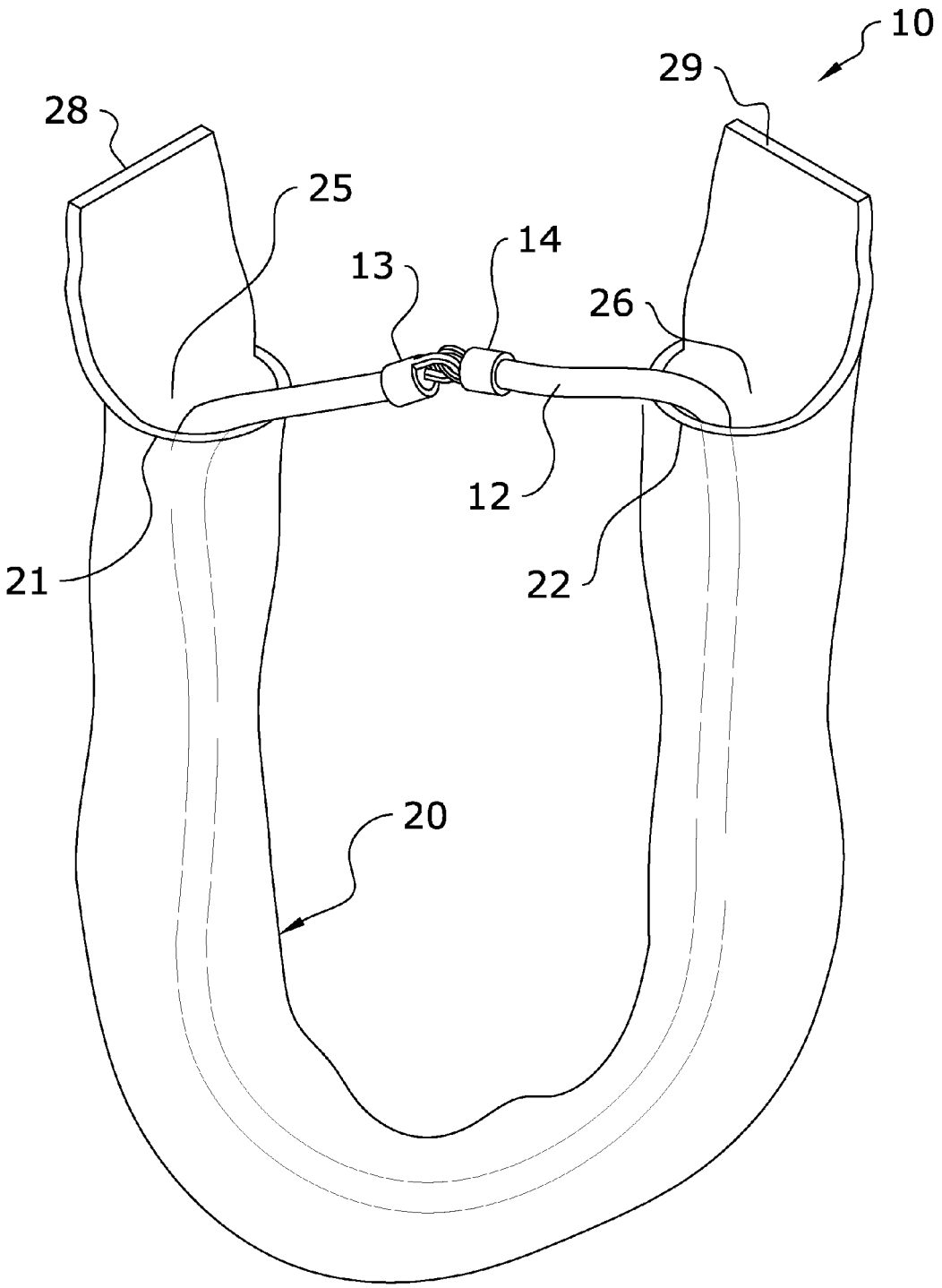
FIG. 13 is a side view of a fourth alternate embodiment of the present invention in use.

The user then grasps both the first end 21 and the second end 22 of the sleeve 20 and crosses the ends 21, 22 as illustrated in FIG. 7. The user then ties the first end 21 and the second end 22 of the sleeve 20 in a loose but sturdy knot, such as not to disturb or tangle the jewelry 12 as illustrated in FIG.

8. The jewelry 12 is now fully enclosed within the interior channel 24 of the sleeve 20 and can be stored such as in a drawer, box or case, displayed such as upon a jewelry tree, worn around the neck or wrist of the user, or transported such as in a handbag. In order to remove the jewelry 12 from the sleeve 20, the previously described steps are simply reversed.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A jewelry storage and transportation system, comprising:

a flexible, tubular sleeve having a first end and a second end;

an interior channel extending from said first end to said second end of said sleeve;

wherein said first end of said sleeve includes a first opening;

wherein said second end of said sleeve includes a second opening;

a jewelry item extending through said interior channel of said sleeve such that a first end of said jewelry item extends through said first opening and a second end of said jewelry item extends through said second opening, wherein said first end of said jewelry item is removably secured to said second end of said jewelry item;

a first fastener positioned adjacent said first end of said sleeve; and a second fastener positioned adjacent said second end of said sleeve, wherein said first fastener and second fastener are operable to removably secure said first end of said sleeve to said second end of said sleeve.

2. The jewelry storage and transportation device of claim 1, wherein said sleeve is transparent.

3. The jewelry storage and transportation device of claim 1, wherein said first fastener and said second fastener are each comprised of clasps.

4. The jewelry storage and transportation device of claim 1, wherein said first fastener and said second fastener are each comprised of hook and loop fasteners.

5. The jewelry storage and transportation device of claim 1, wherein said first fastener and said second fastener are each comprised of ribbons.

6. The jewelry storage and transportation device of claim 1, wherein said first opening is comprised of an angled opening.

7. The jewelry storage and transportation device of claim 5, wherein said second opening is comprised of an angled opening.

8. A method for storing and transporting a jewelry item, comprising:

providing a flexible, tubular, transparent sleeve having a first angled opening at its first end and a second angled opening at its second end, wherein said sleeve includes an internal channel extending from said first angled opening to said second angled opening;

inserting a first end of a jewelry item through said first angled opening of said first sleeve and through said internal channel until said first end of said jewelry item extends out of said second angled opening of said sleeve;

securing said first end of said jewelry item to said second end of said jewelry item; and securing said first end of said sleeve to said second end of said sleeve.

9. The method for storing and transporting a jewelry item of claim 7, wherein said step of securing said first end of said sleeve to said second end of said sleeve is comprised of tying a knot.

10. The method for storing and transporting a jewelry item of claim 7, wherein said sleeve includes a first fastener adjacent said first end and a second fastener adjacent said second end and wherein said step of securing said first end of said sleeve to said second end of said sleeve is comprised of securing said first fastener to said second fastener.

* * * * *